US012390010B2

(12) United States Patent
Xie

(10) Patent No.: US 12,390,010 B2
(45) Date of Patent: Aug. 19, 2025

(54) DOOR ASSEMBLY AND STORAGE CABINET

(71) Applicants: HEFEI MIDEA REFRIGERATOR CO., LTD., Anhui (CN); HEFEI HUALING CO., LTD., Anhui (CN); MIDEA GROUP CO., LTD., Guangdong (CN)

(72) Inventor: Weihao Xie, Anhui (CN)

(73) Assignees: HEFEI MIDEA REFRIGERATOR CO., LTD., Hefei (CN); HEFEI HUALING CO., LTD., Hefei (CN); MIDEA GROUP CO., LTD., Foshan (CN)

( * ) Notice: Subject to any disclaimer, the term of this patent is extended or adjusted under 35 U.S.C. 154(b) by 388 days.

(21) Appl. No.: 18/001,225

(22) PCT Filed: Dec. 29, 2021

(86) PCT No.: PCT/CN2021/142518
§ 371 (c)(1),
(2) Date: Dec. 8, 2022

(87) PCT Pub. No.: WO2022/227667
PCT Pub. Date: Nov. 3, 2022

(65) Prior Publication Data

US 2023/0232979 A1 Jul. 27, 2023

(30) Foreign Application Priority Data

Apr. 30, 2021 (CN) ..... 202110483758.5

(51) Int. Cl.
*A47B 95/02* (2006.01)
*F25D 23/02* (2006.01)

(52) U.S. Cl.
CPC ..... *A47B 95/02* (2013.01); *F25D 23/028* (2013.01); *A47B 2095/026* (2013.01);
(Continued)

(58) Field of Classification Search
CPC . A47B 95/02; A47B 2095/026; F25D 23/028; F25D 2700/02; F25D 2700/04; F25D 2323/02; E05B 13/001
See application file for complete search history.

(56) References Cited

U.S. PATENT DOCUMENTS 6,062,614 A * 5/2000 Petzold ..... E05B 85/14 292/DIG. 31
8,701,428 B2 * 4/2014 Lee ..... F25D 23/126 62/344

(Continued)

FOREIGN PATENT DOCUMENTS

CN 102472558 A 5/2012
CN 103267398 A 8/2013

(Continued)

OTHER PUBLICATIONS

Translation CN111425064A (Year: 2020).*

(Continued)

*Primary Examiner* — Andrew Roersma
(74) *Attorney, Agent, or Firm* — K&L Gates LLP

(57) ABSTRACT

The present application relates to the field of storage technology, and provides a door assembly and a storage cabinet. The door assembly includes a door body provided with a handle groove; a driving assembly; a rack hinged to the door body and provided with a cover plate assembly; and a first detecting member configured to generate a first detecting signal; where the driving assembly is adapted to drive the rack to switch between a pressing state and a resetting state based on the first detecting signal; and in the pressing state, the cover plate assembly avoids the handle groove, and in the resetting state, the cover plate assembly shields the handle groove.

20 Claims, 12 Drawing Sheets

(52) U.S. Cl.
CPC .. *A47B 2220/0077* (2013.01); *F25D 2700/02* (2013.01); *F25D 2700/04* (2013.01)

(56) References Cited

U.S. PATENT DOCUMENTS

| | | | | |
|---|---|---|---|---|
| 10,174,528 | B2 * | 1/2019 | Velicanin | E05B 85/10 |
| 10,253,533 | B1 * | 4/2019 | Pudney | E05F 1/1016 |
| 10,563,903 | B2 * | 2/2020 | Scalf | F24C 15/024 |
| 10,711,494 | B2 * | 7/2020 | Bingle | E05B 81/06 |
| 2004/0177478 | A1 * | 9/2004 | Louvel | E05B 79/06 16/430 |
| 2013/0113357 | A1 | 5/2013 | Park et al. | |
| 2015/0315812 | A1 | 11/2015 | Vasi et al. | |

FOREIGN PATENT DOCUMENTS

| | | | | | |
|---|---|---|---|---|---|
| CN | 109281547 | A | | 1/2019 | |
| CN | 111425064 | A | | 7/2020 | |
| CN | 111578607 | A | | 8/2020 | |
| CN | 113027233 | A | * | 6/2021 | A47B 95/02 |
| CN | 113027234 | A | | 6/2021 | |
| EP | 0972897 | A1 | | 1/2000 | |
| JP | 2008533342 | A | | 8/2008 | |

OTHER PUBLICATIONS

Translation CN11578607A (Year: 2020).*
Japanese Notice of Reasons for Refusal dated Dec. 5, 2023, for the corresponding Japanese Patent Application No. 2022-570227, 5 pages. (With English Translation).

* cited by examiner

DOOR ASSEMBLY AND STORAGE CABINET

CROSS-REFERENCE TO RELATED APPLICATION

The present application claims priority to Chinese Patent Application No. 202110483758.5, filed on Apr. 30, 2021, and entitled "Door Assembly and Storage Cabinet", which is hereby incorporated by reference in entire.

FIELD

The present application relates to the field of storage technology, and in particular, to a door assembly and a storage cabinet.

BACKGROUND

In order to facilitate the opening of a door body of a storage cabinet, the door body of the storage cabinet is usually provided with a handle protruding outward. Since the handle protruding on the door body will affect the appearance of the door body, there is a form of providing a handle plate on a side wall of the door body. Although providing the handle plate on the side wall of the door body can ensure the simplicity and flatness of a front of the door body, a deboss for manual operation to open the door needs to be reserved on a side of the door body whether for a single door body or an opposite door body, which will lead to poor integrity of the door body and affect its appearance.

SUMMARY

The present application is intended to solve at least one of the problems existing in the related art. The present application provides a door assembly, which can ensure that the door body is flat and easy to be opened and closed.

The present application further provides a storage cabinet.

The door assembly according to an embodiment of the present application includes:

a door body, provided with a handle groove;

a driving assembly;

a rack, hinged to the door body and provided with a cover plate assembly; and a first detecting member, configured to generate a first detecting signal, where the driving assembly is adapted to drive the rack to switch between a pressing state and a resetting state based on the first detecting signal; and in the pressing state, the cover plate assembly avoids the handle groove, and in the resetting state, the cover plate assembly shields the handle groove.

According to the door assembly provided by the embodiment of the present application, when a door needs to be opened, the first detecting member can generate a first detecting signal indicating an opening of the door, the driving assembly can drive the rack to switch from the resetting state to the pressing state based on the first detecting signal, and then the handle groove can be exposed on the door body. At this time, the door body can be opened by bucking and pulling the handle groove. In this way, the door body can be opened without providing a handle on the door body or providing a handle plate on a surface of the door body, so as to ensure the flatness of a front of the door body. When an action of closing the door body occurs or the door body is already in a closed state, the first detecting member can generate a first detecting signal indicating an closing of the door, and the driving assembly can drive the cover plate assembly to return to the resetting state and shield the handle groove based on the first detecting signal, and then the door body can recover to a flat and concise state, which not only ensures the flatness and conciseness of the door body, but also is convenient for a user to open and close the door body.

According to an embodiment of the present application, the rack includes:

a first swiveling rack, where a first end of the first swiveling rack is hinged to the door body, and a second end of the first swiveling rack is hinged to the cover plate assembly; and a second swiveling rack, where a first end of the second swiveling rack is hinged to the door body, and a second end of the second swiveling rack is hinged to the cover plate assembly, where the driving assembly is adapted to drive the first swiveling rack and/or the second swiveling rack to move the cover plate assembly in a direction perpendicular to the door body.

According to an embodiment of the present application, the first swiveling rack includes:

a first driving shaft, where two ends of the first driving shaft are hinged to the door body;

a first driven shaft, where two ends of the first driven shaft are hinged to the cover plate assembly; and a first transition connecting member, connected between the first driving shaft and the first driven shaft;

the second swiveling rack includes:

a second driving shaft, where two ends of the second driving shaft are hinged to the door body;

a second driven shaft, where two ends of the second driven shaft are hinged to the cover plate assembly; and a second transition connecting member, connected between the second driving shaft and the second driven shaft.

According to an embodiment of the present application, the first transition connecting member is positioned at the first driving shaft and/or the first driven shaft through a first limiting structure; and the second transition connecting member is positioned at the second driving shaft and/or the second driven shaft through a second limiting structure.

According to an embodiment of the present application, the driving assembly includes a motor, where the motor is mounted on the door body, and the motor is connected to the first driving shaft and/or the second driving shaft.

According to an embodiment of the present application, the motor is connected to an end of the first driving shaft and/or an end of the second driving shaft through a shaft coupling; or, the motor is connected to the first driving shaft and/or the second driving shaft in a transmission manner through a transmission assembly.

According to an embodiment of the present application, the driving assembly includes a motor and an elastic member;

where the motor is connected to the first driving shaft and/or the second driving shaft;

the elastic member is sleeved on the first driving shaft, and two ends of the elastic member abut against the door body and the first transition connecting member respectively; and/or, the elastic member is sleeved on the second driving shaft, and two ends of the elastic member abut against the door body and the second transition connecting member respectively.

According to an embodiment of the present application, the driving assembly includes a magnetic member, where the magnetic member is mounted on the door body, and the magnetic member is adapted to drive the rack to switch between the pressing state and the resetting state based on the first detecting signal.

According to an embodiment of the present application, the door assembly further includes a second detecting member, where the second detecting member is mounted on the door body, and the second detecting member is adapted to generate a second detecting signal for controlling the motor to stop after detecting that the rack switches to the resetting state.

According to an embodiment of the present application, the first driving shaft and/or the second driving shaft is sleeved with a swing rod, and in the resetting state, the swing rod is adapted to trigger the second detecting member to generate the second detecting signal.

According to an embodiment of the present application, the door body is provided with a mounting plate, the motor is mounted on the mounting plate, and a shock pad is provided between the mounting plate and the motor;

where an output shaft of the motor is connected to the end of the first driving shaft and/or the end of the second driving shaft through the shaft coupling; or, the output shaft of the motor is connected to the first driving shaft and/or the second driving shaft in a transmission manner through a transmission assembly.

According to an embodiment of the present application, the first transition connecting member and/or the second transition connecting member is limited at the door body through a groove side wall of the handle groove, to prevent the first transition connecting member and/or the second transition connecting member from disengaging from the door body.

According to an embodiment of the present application, the cover plate assembly includes:

a cover plate base, where two ends of the first driven shaft and two ends of the second driven shaft are hinged to the cover plate base respectively; and a cover plate body, mounted on the cover plate base.

According to an embodiment of the present application, the door assembly further includes a light bar, where the cover plate base is provided with a mounting space for mounting the light bar, and the cover plate body is provided with a light transmission area at a position corresponding to the light bar.

According to an embodiment of the present application, the door body includes a supporting base, and the handle groove is provided on the supporting base; and the first end of the first swiveling rack and the first end of the second swiveling rack are hinged to the support, and the second end of the first swiveling rack and the second end of the second swiveling rack are hinged to the cover plate assembly.

According to an embodiment of the present application, the door body further includes a mounting base, and the supporting base is mounted on the mounting base.

The storage cabinet according to an embodiment of the present application includes any one of the above-mentioned door assemblies.

According to the storage cabinet provided by the embodiment of the present application, by providing the above-mentioned door assembly, on the premise of ensuring the convenience of opening and closing the door body, the surface of the door body can be kept flat and concise when the door body is in the closed state.

The above-mentioned one or more solutions in the embodiments of the present application have at least one of the following effects.

According to the door assembly provided by the embodiment of the present application, when a door needs to be opened, the first detecting member can generate a first detecting signal indicating an opening of the door, the driving assembly can drive the rack to switch from the resetting state to the pressing state based on the first detecting signal, and then the handle groove can be exposed on the door body. At this time, the door body can be opened by bucking and pulling the handle groove. In this way, the door body can be opened without providing a handle on the door body or providing a handle plate on a surface of the door body, so as to ensure the flatness of a front of the door body. When an action of closing the door body occurs or the door body is already in a closed state, the first detecting member can generate a first detecting signal indicating an closing of the door, and the driving assembly can drive the cover plate assembly to return to the resetting state and shield the handle groove based on the first detecting signal, and then the door body can recover to a flat and concise state, which not only ensures the flatness and conciseness of the door body, but also is convenient for a user to open and close the door body.

In an embodiment, according to the storage cabinet provided by the embodiment of the present application, by providing the above-mentioned door assembly, on the premise of ensuring the convenience of opening and closing the door body, the surface of the door body can be kept flat and concise when the door body is in the closed state.

Additional aspects and advantages of the present application will be given in part in the following description, and the part will become clear from the following description, or will be learned by practice of the present application.

BRIEF DESCRIPTION OF DRAWINGS

In order to more clearly illustrate the solutions according to the present application or the related art, the accompanying drawings used in the description of the embodiments of the present application or the related art will be briefly introduced below. It should be noted that the drawings in the following description are only part embodiments of the present application. For those of ordinary skill in the art, other drawings can also be obtained according to these drawings without creative efforts.

Figure 1:
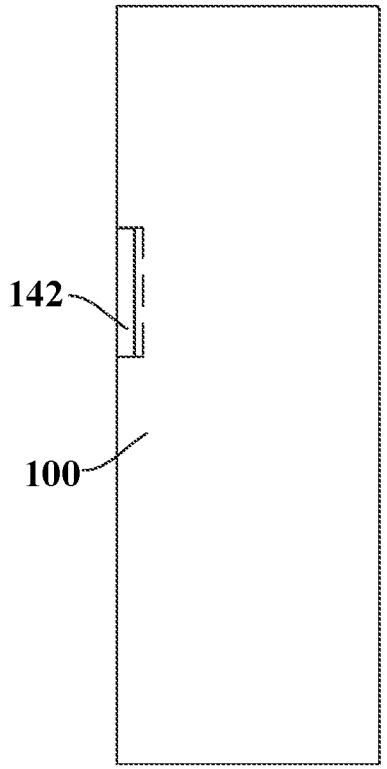
FIG. 1 is a schematic structural diagram of a first door body according to an embodiment of the present application.

Reference numerals: 100—door body; 102—handle groove; 104—supporting base; 106—first swiveling rack; 108—second swiveling rack; 110—first driving shaft; 112—first driven shaft; 114—first transition connecting member; 116—second driving shaft; 118—second driven shaft; 120—second transition connecting member; 122—first limiting structure; 124—second limiting structure; 126—motor; 128—elastic member; 130—second detecting member; 132—swing rod; 134—mounting plate; 136—shock pad; 138—shaft coupling; 140—cover plate base; 142—cover plate body; 144—light bar; 146—mounting base; 148—third detecting member; 150—swing arm; 152—driving gear; 154—driven gear.

DETAILED DESCRIPTION OF THE EMBODIMENTS

The embodiments of the present application will be described in further detail below with reference to the drawings and embodiments. The following embodiments are intended to illustrate the present application, but not to limit the scope of the present application.

In the description of the embodiments of the present application, it should be noted that, the orientation or positional relations indicated by terms such as "center", "longitudinal", "transverse", "upper", "lower", "front", "rear", "left", "right", "vertical", "horizontal", "top", "bottom", "inner", "outer" and the like are based on the orientation or positional relations shown in the drawings, which are merely convenience of description of the embodiments of the present application and to simplify description, but does not indicate or imply that the stated device or element must have the particular orientation, or be constructed and operated in a particular orientation, and thus it is not to be construed as limiting the embodiments of the present application. Furthermore, the terms "first", "second" and "third" are used for descriptive purposes only and should not be construed as indicating or implying a relative importance.

In the description of the present application, it should be noted that unless explicitly specified and defined otherwise, the terms "connected to" and "connected" shall be understood broadly, for example, it may be either fixedly connected or detachably connected, or can be integrated; it may be either mechanically connected, or electrically connected; it may be either directly connected, or indirectly connected through an intermediate medium. The specific meanings of the terms above in the present application can be understood by a person skilled in the art in accordance with specific conditions.

In the embodiments of the present application, unless otherwise expressly specified and defined, a first feature is "on" or "under" a second feature can refer to that the first feature is directly contacted with the second feature, or the first feature is indirectly contacted with the second feature through an intermediate medium. And further, the first feature is "on", "above" and "over" the second feature can refer to that the first feature is directly above or obliquely above the second feature, or simply refer to that the level height of the first feature is higher than that of the second feature. The first feature is "under", "below" and "beneath" the second feature can refer to that the first feature is directly below or obliquely below the second feature, or simply refer to that the level height of the first feature is lower than that of the second feature.

In the description of this specification, description with reference to the terms "one embodiment", "some embodiments", "an example", "specific example", "some examples" and the like, refers to that specific features, structures, materials or characteristics described in combination with an embodiment or an example are included in at least one embodiment or example according to the embodiments of the present application. In this specification, schematic representations of the above terms are not necessarily directed to a same embodiment or example. Furthermore, the particular features, structures, materials or characteristics described can be combined in any suitable manner in any one or more embodiments or examples. In addition, those skilled in the art can combine the different embodiments or examples described in this specification, as well as the features of the different embodiments or examples, without conflicting each other.

As shown in FIG. 1 to FIG. 25, a door assembly according to an embodiment of the present application mainly includes a door body 100, a driving assembly, a rack and a first detecting member (not shown in the figures). The door body 100 is provided with a handle groove 102; the rack is hinged to the door body 100 and provided with a cover plate assembly; the first detecting member is configured to generate a first detecting signal; the driving assembly is adapted to drive the rack to switch between a pressing state and a resetting state based on the first detecting signal; and in the pressing state, the cover plate assembly avoids the handle groove 102, and in the resetting state, the cover plate assembly shields the handle groove 102.

According to the door assembly provided by the embodiment of the present application, when a door needs to be opened, the first detecting member can generate a first detecting signal indicating an opening of the door, the driving assembly can drive the rack to switch from the resetting state to the pressing state based on the first detecting signal, and then the handle groove 102 can be exposed on the door body 100. At this time, the door body 100 can be opened by bucking and pulling the handle groove 102. In this way, the door body 100 can be opened without providing a handle on the door body 100 or providing a handle plate on a surface of the door body 100, so as to ensure the flatness of a front of the door body 100. When an action of closing the door body 100 occurs or the door body 100 is already in a closed state, the first detecting member can generate a first detecting signal indicating an closing of the door, and the driving assembly can drive the cover plate assembly to return to the resetting state and shield the handle groove 102 based on the first detecting signal, and then the door body 100 can recover to a flat and concise state, which not only ensures the flatness and conciseness of the door body 100, but also is convenient for a user to open and close the door body 100.

The door assembly provided by the embodiments of the present application applying to a refrigerator will be taken as an example in the following. In the embodiments of the present application, the number of the door body 100 can be one or more. In other words, the door assembly provided by the embodiments of the present application can be applied to a single door refrigerator or an opposite door refrigerator.

The door body 100 is provided with a handle groove 102 that can be buckled by a user. When the handle groove 102 is exposed outside, the user can hold the handle groove 102 to open the door body 100.

It should be noted that, referring to FIG. 1 to FIG. 4 and FIG. 6, the position of the door assembly provided by the embodiments of the present application on the door body 100 is not limited.

Figure 6:
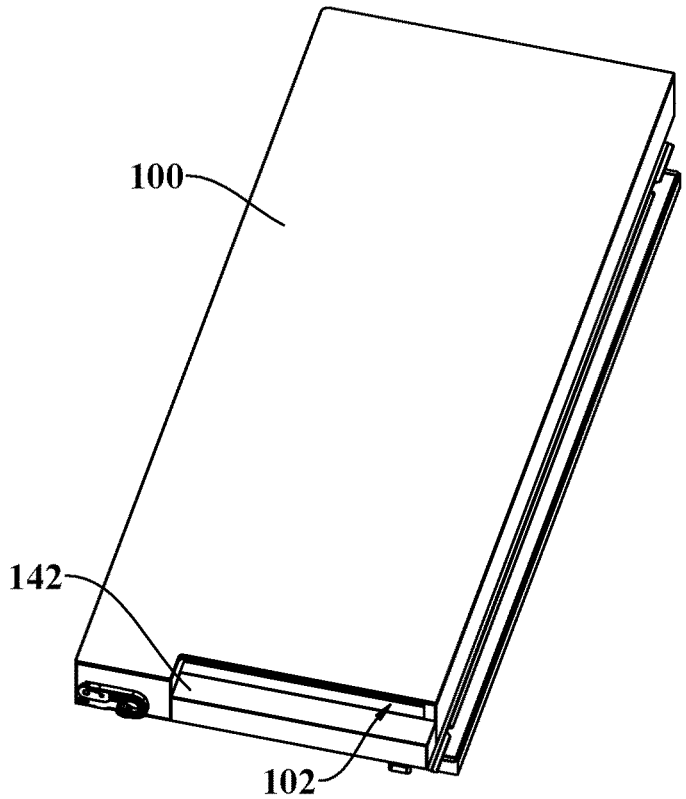
FIG. 6 is a schematic structural diagram of a door assembly with a handle groove being opened according to an embodiment of the present application.

As shown in FIG. 1 and FIG. 6, when the number of the door body 100 is one, the handle groove 102 can be provided near an edge of the door body 100, for example, the handle groove 102 can be provided at the area shown by the dotted line in FIG. 1. After the driving assembly drives the cover plate assembly to switch to the pressing state, the handle groove 102 provided on the door body 100 can be exposed.

As shown in FIG. 2 to FIG. 4 and FIG. 6, when the number of the door bodies 100 is multiple, the handle groove 102 can be provided at an edge of any door body 100, and it can also be provided at a non-edge position of the door body 100 as required. Therefore, when the user intends to open the door body 100, the driving assembly can drive the cover plate assembly on the door body 100, and then the handle groove 102 on the door body 100 can be exposed, so that the user can hold the handle groove 102 to open the door body 100.

Alternatively, the driving assembly is configured to drive the cover plate assembly on the door body 100 to expose the handle groove 102 on the adjacent door body 100, and then the user can open the adjacent door body 100. In other words, the user can flexibly choose to open the corresponding door body 100 according to an actual demand.

Figure 2:
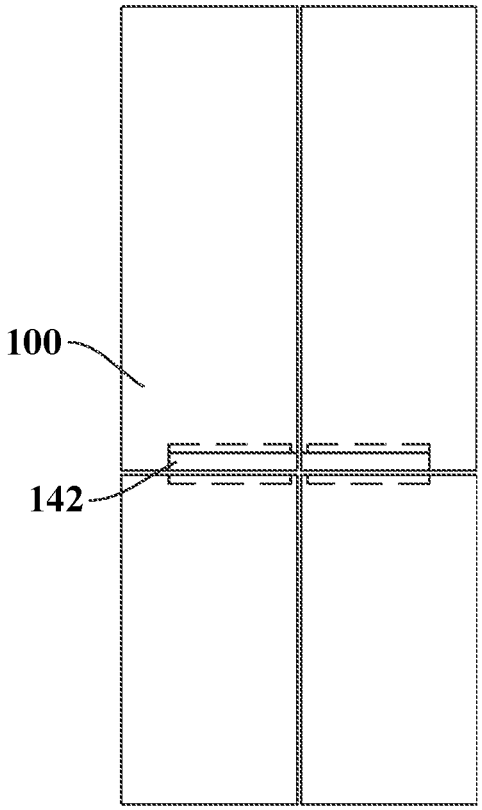
FIG. 2 is a schematic structural diagram of a second door body according to an embodiment of the present application.
Figure 3:
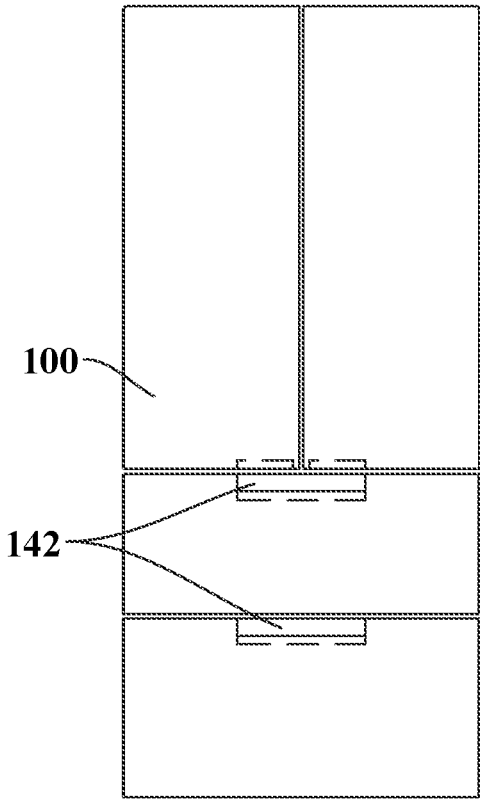
FIG. 3 is a schematic structural diagram of a third door body according to an embodiment of the present application.
Figure 4:
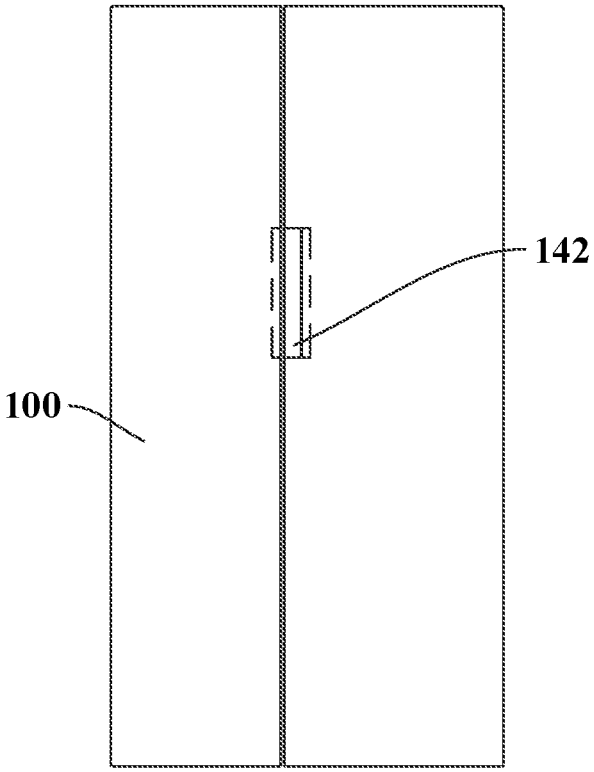
FIG. 4 is a schematic structural diagram of a fourth door body according to an embodiment of the present application.
Figure 5:
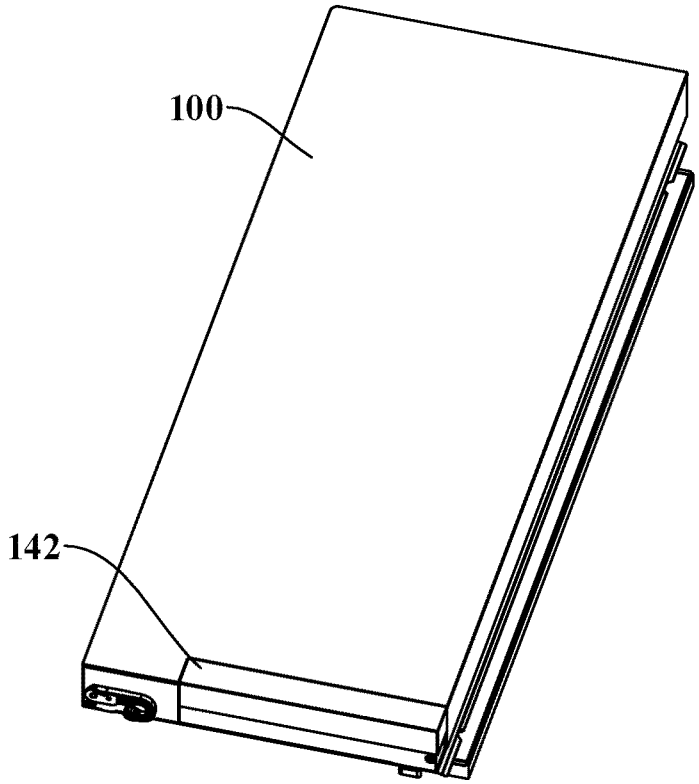
FIG. 5 is a schematic structural diagram of a door assembly with a handle groove being shielded according to an embodiment of the present application.

The areas shown by the dotted line in FIG. 2 to FIG. 4 are the areas of providing the handle groove 102, for example, when the number of door bodies 100 is multiple, multiple handle grooves 102 can be provided on two adjacent door bodies 100 respectively, which can facilitate the user to open the door bodies 100.

In an embodiment of the present application, the door assembly further includes a supporting base 104 mounting on the door body 100, and the above-mentioned handle groove 102 is provided on the supporting base 104. For example, the supporting base 104 can be mounted in a foaming layer of the door body 100.

According to an embodiment of the present application, the door assembly further includes a mounting base 146, where the mounting base 146 is provided on the door body 100, and the supporting base 104 is mounted on the mounting base 146. The shape of the mounting base 146 is adapted to the shape of the supporting base 104. The mounting base 146 can be provided in the foaming layer of the door body 100. By providing the mounting base 146 in the foaming layer of the door body 100, the foaming material in the foaming layer can be prevented from entering the supporting base 104, thereby preventing the foaming material from affecting the components such as the supporting base 104, the rack and the cover plate assembly.

A first end of the rack is hinged to the supporting base 104, a second end of the rack is provided with a cover plate assembly, and the rack is adapted to switch between the pressing state and the resetting state. In the pressing state, the cover plate assembly avoids the handle groove 102; and in the resetting state, the cover plate assembly shields the handle groove 102.

As mentioned above, when the rack is in the pressing state, the cover plate assembly mounted on the rack can avoid the handle groove 102, so that the handle groove 102 is exposed outside, and then the user can hold the handle groove 102 to open the door body 100. When the rack is in the resetting state, the cover plate assembly mounted on the rack can shield the handle groove 102, so that the door body 100 is in a flat and concise state. The pressing state mentioned here refers to that when the driving assembly drives the rack to move the cover plate assembly toward the position retracted to the door body 100, the cover plate assembly exposes the handle groove 102 to the outside, and at this time, the rack is in the pressing state. The resetting state refers to that the rack is driven to switch the cover plate assembly from the state of being retracted to the door body 100 to the state of being flush with an outer surface of the door body 100, and at this time, the rack is in the resetting state.

In an embodiment of the present application, the driving assembly can be mounted in the supporting base 104, where the driving assembly is mainly configured to control the rack to switch between the pressing state and the resetting state.

According to an embodiment of the present application, the rack includes a first swiveling rack 106 and a second swiveling rack 108. A first end of the first swiveling rack 106 is hinged to the supporting base 104, and a second end of the first swiveling rack 106 is hinged to the cover plate assembly. A first end of the second swiveling rack 108 is hinged to the supporting base 104, and a second end of the swiveling rack 108 is hinged to the cover plate assembly. The driving assembly is adapted to drive the first swiveling rack 106 and/or the second swiveling rack 108, to move the cover plate assembly in a direction perpendicular to the door body 100.

Figure 10:
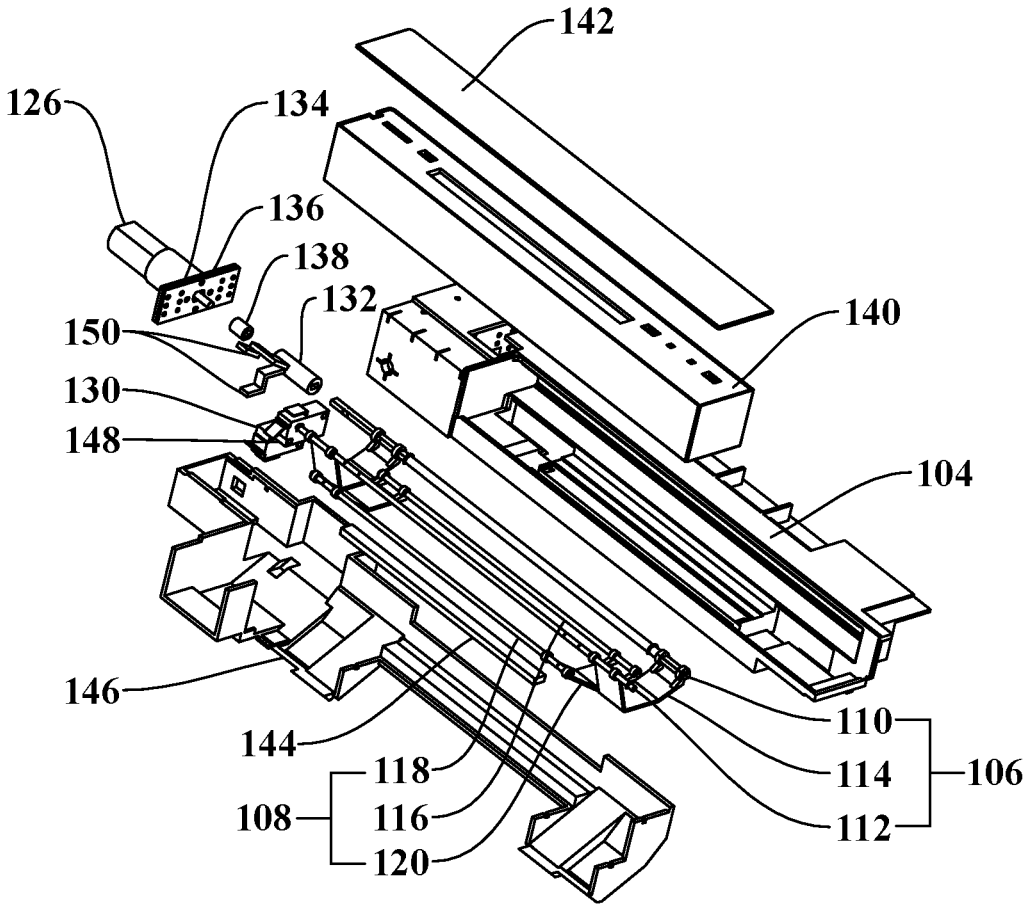
FIG. 10 is a schematic exploded view of a supporting base, a first swiveling rack, and a second swiveling rack according to an embodiment of the present application.

Referring to FIG. 10, for example, the first swiveling rack 106 and the second swiveling rack 108 together constitute the rack in the embodiments of the present application. The first end of the first swiveling rack 106 and the first end of the second swiveling rack 108 are respectively hinged to the supporting base 104, and the second end of the first swiveling rack 106 and the second end of the second swiveling rack 108 are respectively hinged to the cover plate assembly. In this way, the cover plate assembly can move relative to the supporting base 104 under the hinged action of the first swiveling rack 106 and the second swiveling rack 108.

In an embodiment, the driving assembly can be connected to the first swiveling rack 106 or the second swiveling rack 108 respectively, or the driving assembly can be connected to the first swiveling rack 106 and the second swiveling rack 108 respectively. Through the driving of the driving assembly, the first swiveling rack 106 and/or the second swiveling rack 108 can be led to swivel, so as to move the cover plate assembly relative to the supporting base 104. In an embodiment of the present application, the first swiveling rack 106 and the second swiveling rack 108 can be drive to move the cover plate assembly in a direction perpendicular to the door body 100. For example, the cover plate assembly can move in a direction perpendicular to the door body 100 relative to the door body 100.

According to an embodiment of the present application, the first swiveling rack 106 includes a first driving shaft 110, a first driven shaft 112 and a first transition connecting member 114. The second swiveling rack 108 includes a second driving shaft 116, a second driven shaft 118 and a second transition connecting member 120. Two ends of the first driving shaft 110 are hinged to the supporting base 104, two ends of the first driven shaft 112 are hinged to the cover plate assembly, and the first transition connecting member 114 is connected between the first driving shaft 110 and the first driven shaft 112. Two ends of the second driving shaft 116 are hinged to the supporting base 104, two ends of the second driven shaft 118 are hinged to the cover plate assembly, and the second transition connecting member 120 is connected between the second driving shaft 116 and the second driven shaft 118.

For example, referring to FIG. 9 to FIG. 12, two ends of the first driving shaft 110 and two ends of the second driving shaft 116 are hinged to the supporting base 104 respectively, and the two ends of the first driven shaft 112 and the two ends of the second driven shaft 118 are hinged to the cover plate assembly respectively. In order to improve the connection stability between the first driving shaft 110 and the first driven shaft 112, the first transition connecting member 114 is connected between the first driving shaft 110 and the first driven shaft 112. Correspondingly, a second transition connecting member 120 is connected between the second driving shaft 116 and the second driven shaft 118.

It should be noted that when the driving assembly is only connected to the first driving shaft 110 of the first swiveling rack 106, the first driven shaft 112, the second driving shaft 116 and the second driven shaft 118 can be set to be disconnected in the middle, and it is only needed to set a length of the first driving shaft 110 to be equal to a width of the supporting base 104.

Figure 14:
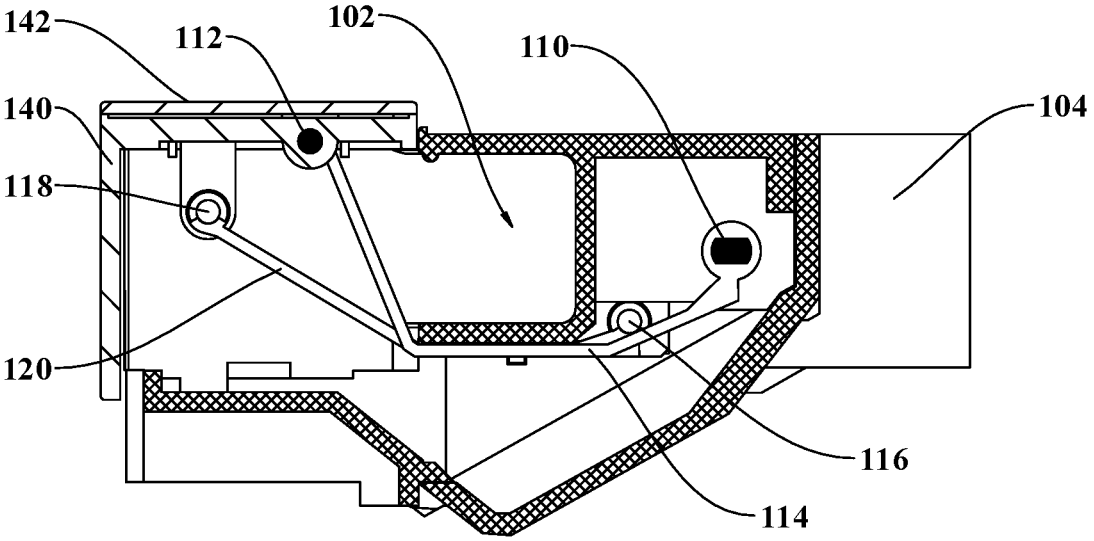
FIG. 14 is a schematic cross-sectional view of FIG. 13 in an A-A direction.
Figure 15:
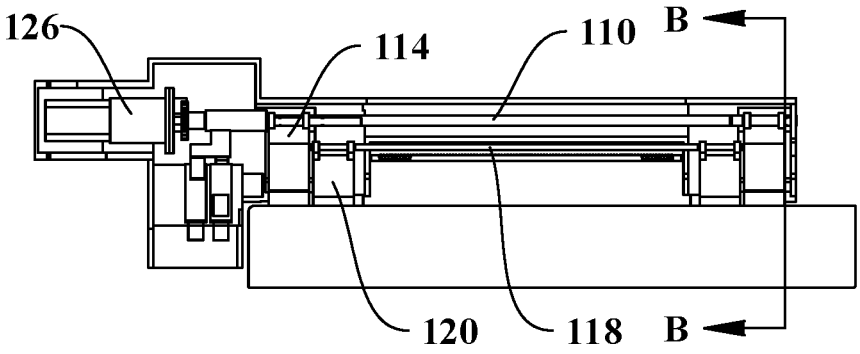
FIG. 15 is a schematic front view of a cover plate assembly avoiding a handle groove according to an embodiment of the present application.
Figure 16:
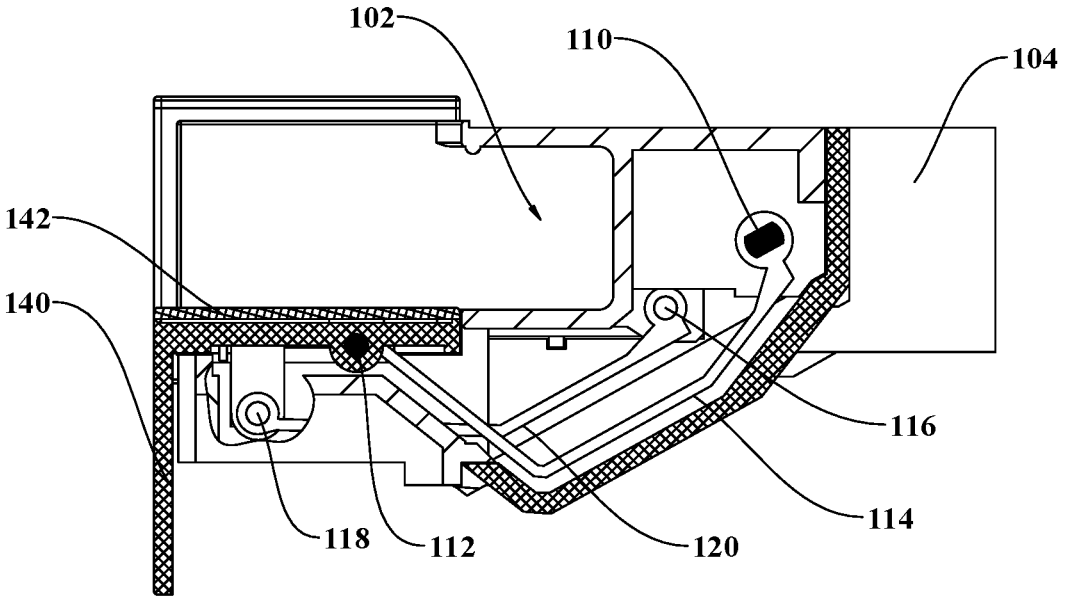
FIG. 16 is a schematic cross-sectional view of FIG. 15 in a B-B direction.
Figure 17:
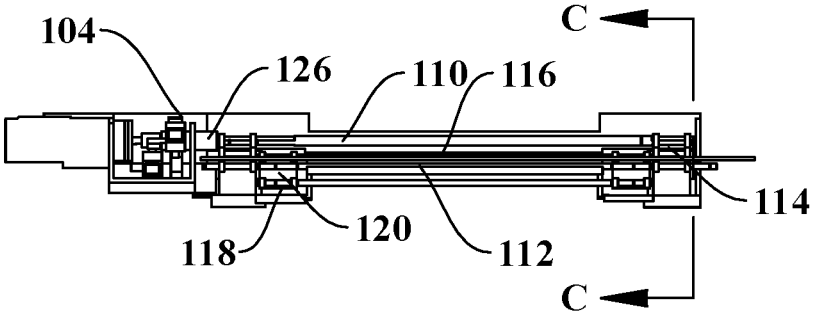
FIG. 17 is a schematic front view of a cover plate assembly in a middle position of shielding a handle groove and avoiding a handle groove according to an embodiment of the present application.
Figure 18:
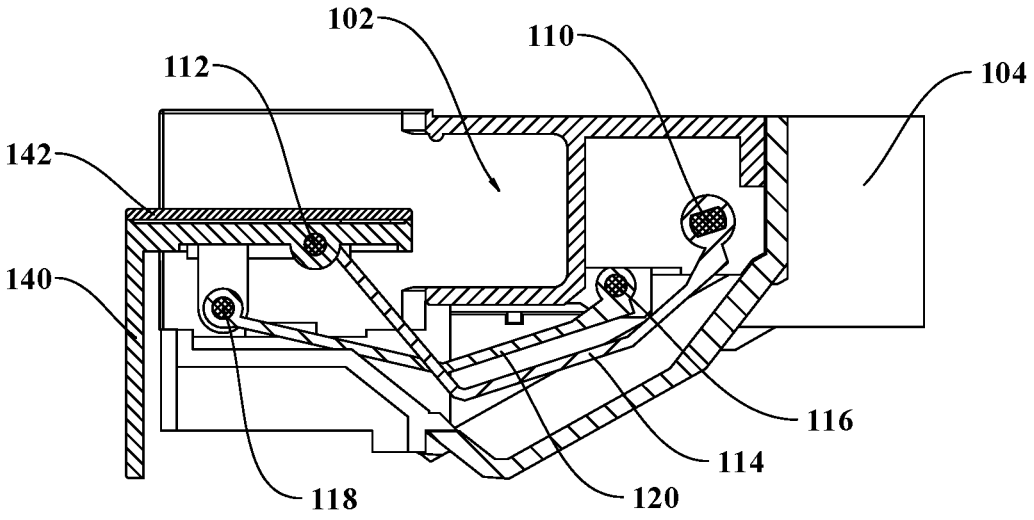
FIG. 18 is a schematic cross-sectional view of FIG. 17 in a C-C direction.
Figure 19:
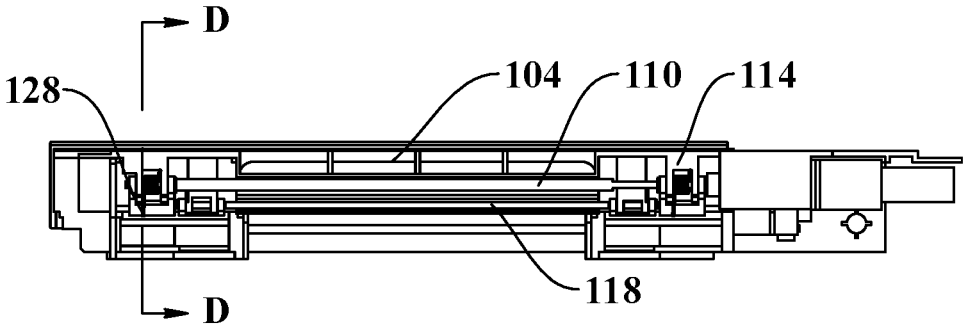
FIG. 19 is a schematic structural diagram of a driving assembly connecting to a rack according to an embodiment of the present application.
Figure 20:
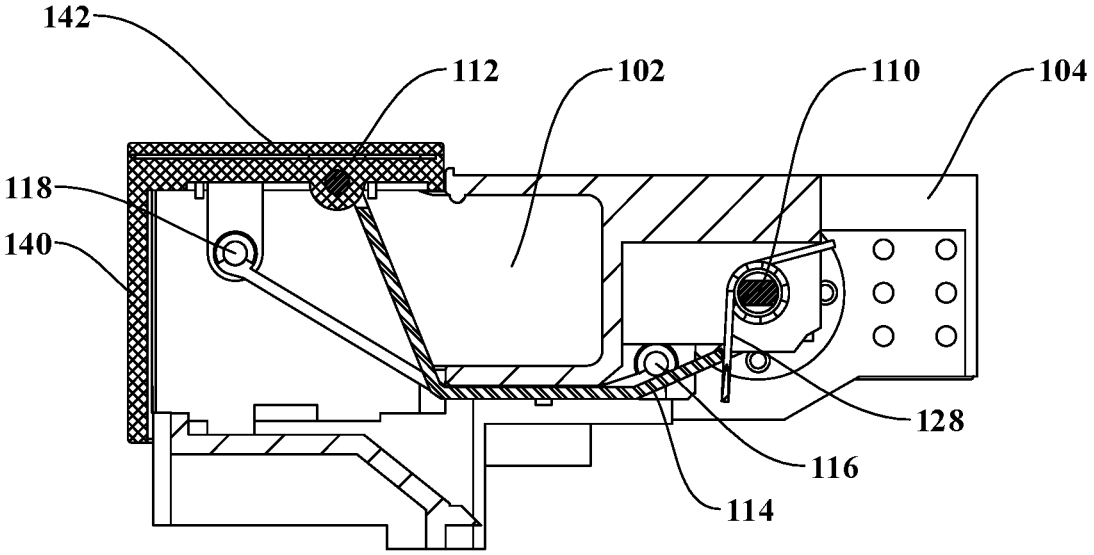
FIG. 20 is a schematic cross-sectional view of FIG. 19 in a D-D direction.
Figure 21:
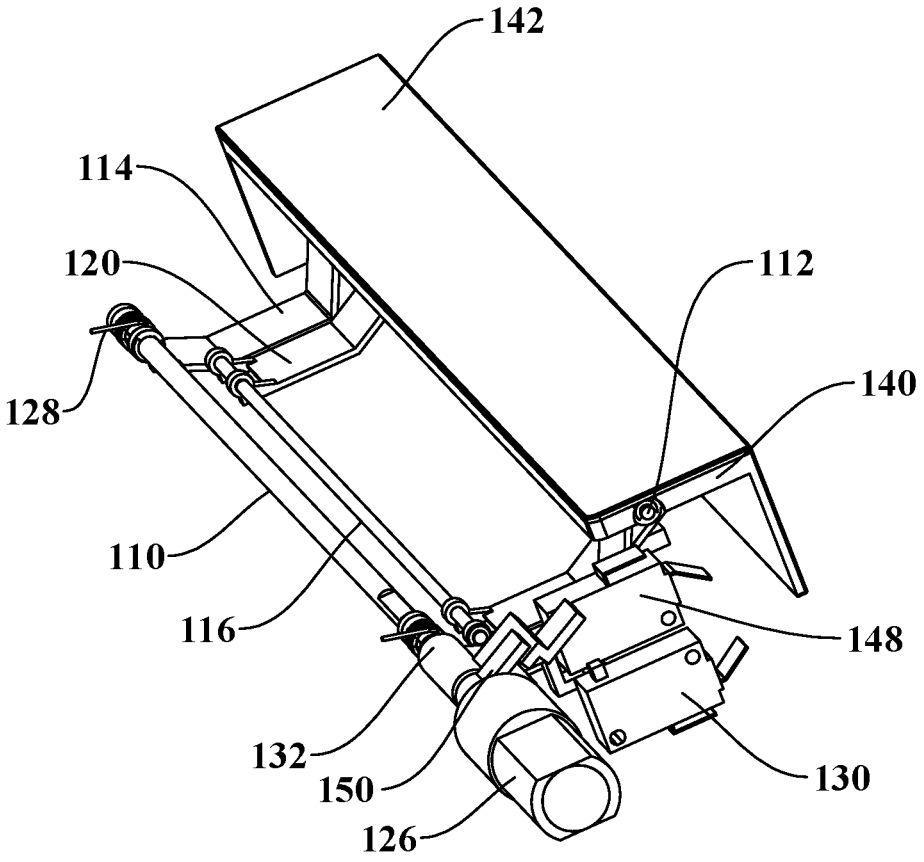
FIG. 21 is a schematic stereoscopic diagram corresponding to FIG. 19.
Figure 22:
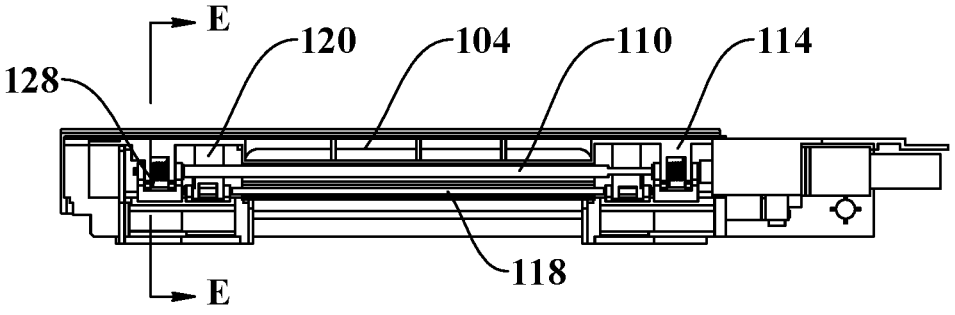
FIG. 22 is a schematic front view of another driving assembly connecting to a rack according to an embodiment of the present application.
Figure 23:
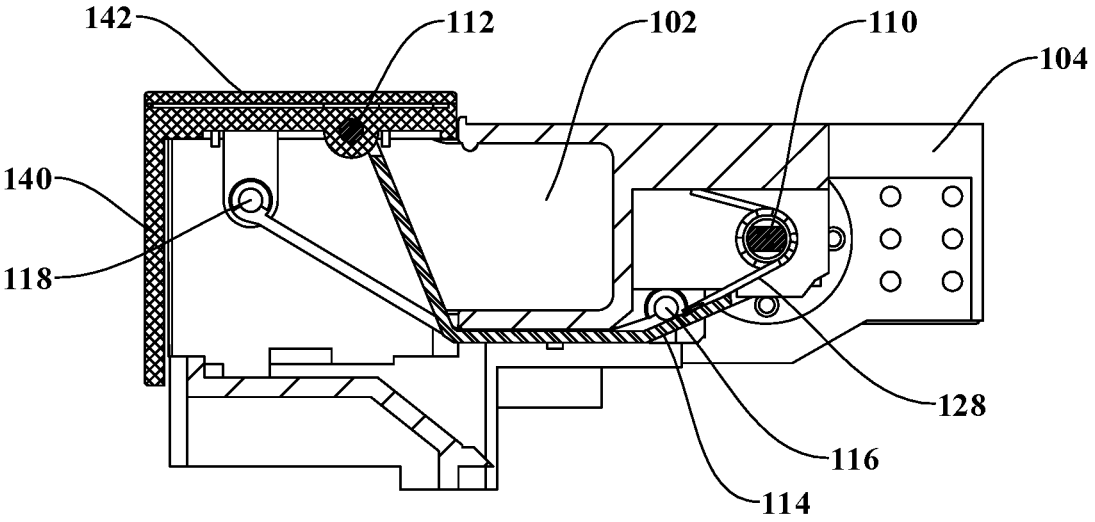
FIG. 23 is a schematic cross-sectional view of FIG. 22 in an E-E direction.
Figure 24:
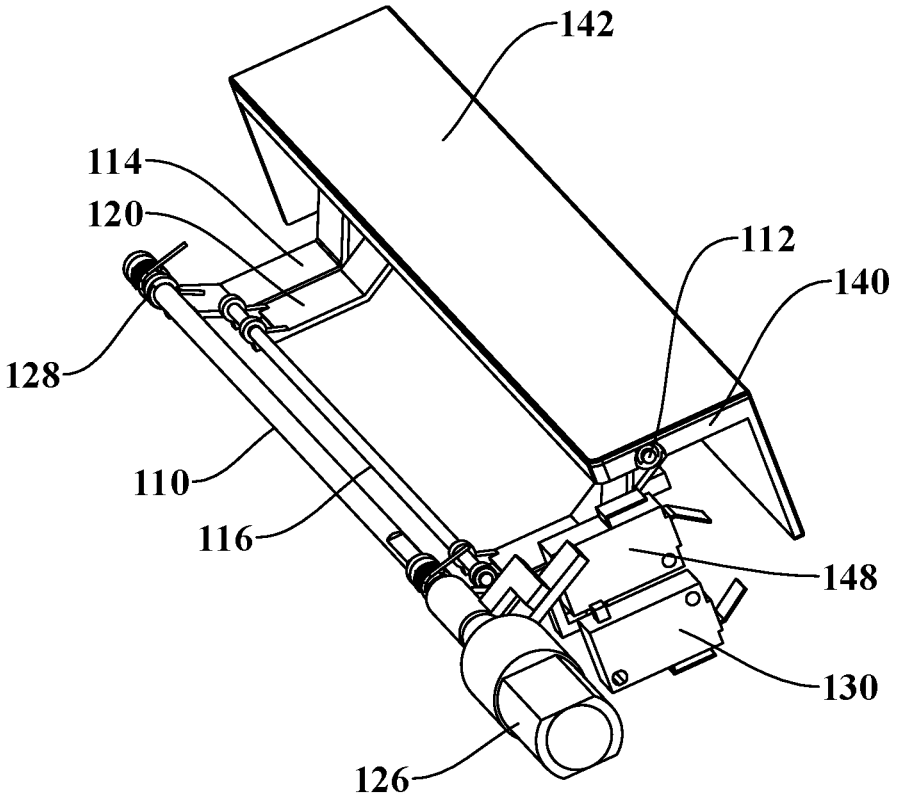
FIG. 24 is a schematic stereoscopic diagram corresponding to FIG. 22.

Referring to FIG. 14, FIG. 16 and FIG. 18, these figures show a hinge point of the first driving shaft 110 and the supporting base 104, a hinge point of the second driving shaft 116 and the supporting base 104, a hinge point of the first driven shaft 112 and the cover plate assembly, and a hinge point of the second driven shaft 118 and the cover plate assembly. A parallelogram can be formed by connecting these four hinge points in sequence. Since the hinge point of the first driving shaft 110 and the supporting base 104 and the hinge point of the second driving shaft 116 and the supporting base 104 are fixed points, a relative distance between the two hinge points and an inclination angle of the connecting line of the two hinge points is also fixed. Therefore, a distance between the hinge point of the first driven shaft 112 and the cover plate assembly and the hinge point of the second driven shaft 118 and the cover plate assembly is equal to the distance between the hinge point of the first driving shaft 110 and the supporting base 104 and the hinge point of the second driving shaft 116 and the supporting base 104. The connecting line between the hinge point of the first driven shaft 112 and the cover plate assembly and the hinge point of the second driven shaft 118 and the cover plate assembly is parallel to the connecting line between the hinge point of the first driving shaft 110 and the supporting base 104 and the hinge point of the second driving shaft 116 and the supporting base 104, and then as shown in FIG. 14, FIG. 16 or FIG. 18, the cover plate assembly can perform vertical translational motion along the direction perpendicular to the door body 100.

In an embodiment, as shown in FIG. 18, during the cover plate assembly moving from the position of shielding the handle groove 102 to the position of avoiding the handle groove 102, the cover plate assembly first translates to a left side as shown in FIG. 18 for a distance about 1 mm to 3 mm, and then translates to a right side as shown in FIG. 18 for a distance about 1 mm to 3 mm, and finally moves to the position of avoiding the handle groove 102 as shown in FIG. 16. Similarly, during the cover plate assembly moving from the position of avoiding the handle groove 102 to the position of shielding the handle groove 102, the cover plate assembly first translates to the left side as shown in FIG. 18 for a distance about 1 mm to 3 mm, and then translates to the right side as shown in FIG. 18 for a distance about 1 mm to 3 mm, and finally moves to the position of shielding the handle groove 102 as shown in FIG. 14.

According to an embodiment of the present application, the first transition connecting member 114 is adapted to be positioned at the first driving shaft 110 and/or the first driven shaft 112 through a first limiting structure 122; and the second transition connecting member 120 is adapted to be positioned at the second driving shaft 116 and/or the second driven shaft 118 through a second limiting structure 124.

In an embodiment of the present application, in order to prevent the first transition connecting member 114 from performing axial movement relative to the first driving shaft 110 and/or the first driven shaft 112, the first driving shaft 110 and the first driven shaft 112 can be provided with two first positioning blocks respectively, and a first end of the first transition connecting member 114 can be connected between the two first positioning blocks on the first driving shaft 110, and a second end of the first transition connecting member 114 can be connected between the two first positioning blocks on the first driven shaft 112. In other embodiments, two first positioning blocks may be only provided on the first driving shaft 110 or the first driven shaft 112, and then the first transition connecting member 114 may be connected between the two first positioning blocks. In this way, the objective of preventing the first transition connecting member 114 from performing axial movement relative to the first driving shaft 110 or the first driven shaft 112 can also be achieved.

Similarly, the second driving shaft 116 and the second driven shaft 118 can be provided with two second positioning blocks respectively. A first end of the second transition connecting member 120 can be connected between the two second positioning blocks on the second driving shaft 116, and a second end of the second transition connecting member 120 can be connected between the two second positioning blocks on the second driven shaft 118. In other embodiments, two second positioning blocks may be only provided on the second driving shaft 116 or the second driven shaft 118, and then the second transition connecting member 120 may be connected between the two second positioning blocks. In this way, the objective of preventing the second transition connecting member 120 from performing axial movement relative to the second driving shaft 116 or the second driven shaft 118 can also be achieved.

In other embodiments, the positions of the first transition connecting member 114 and the second transition connecting member 120 can be limited in other forms. For example, the first driving shaft 110 and/or the second driving shaft 116 are provided with positioning pins, positioning bosses, etc.

Referring to FIG. 14, FIG. 16 and FIG. 18, for the consideration of space layout, both of the first transition connecting member 114 and the second transition connecting member 120 can have a shape of bending toward an inner surface of the door body 100. Correspondingly, the supporting base 104 is provided with an accommodation space for accommodating a bent portion of the first transition connecting member 114 and a bent portion of the second transition connecting member 120. In an embodiment, as long as the first transition connecting member 114 can be connected to the first driving shaft 110 and the second driving shaft 116, a width of the first transition connecting member 114 does not need to be set to equal with the length of the first driving shaft 110, and as long as the second transition connecting member 120 can be connected to the second driving shaft 116 and the second driven shaft 118, a width of the second transition connecting member 120 does not need to be set to equal with the length of the second driving shaft 116. In addition, in some embodiments of the present application, the positions of the first transition connecting member 114 and the second transition connecting member 120 are staggered in a spatial width direction, to avoid an interference between the first transition connecting member 114 and the second transition connecting member 120 during rotation.

In order to prevent the first transition connecting member 114 and/or the second transition connecting member 120 from disengaging from the supporting base 104, the first transition connecting member 114 and/or the second transition connecting member 120 is adapted to be limited at the supporting base 104 through a groove side wall of the handle groove 102.

Referring to FIG. 14, the handle groove 102 is a groove-like structure formed on an edge of the supporting base 104. Therefore, as shown in FIG. 10, the groove side wall located below of the handle groove 102 can be used as a limiting structure for preventing the first transition connecting member 114 and the second transition connecting member 120 from disengaging from the supporting base 104. In other words, as shown in FIG. 14, when the rack is switched to the resetting state, a side of the first transition connecting member 114 facing an outer side surface of the door body 100 and a side of the second transition connecting member 120 facing the outer side surface of the door body 100 can abut against on the groove side wall located below of the handle groove 102, so that the first transition connecting member 114 and the second transition connecting member 120 can be prevented from disengaging from the supporting base 104, and correspondingly, the first swiveling rack 106 and the second swiveling rack 108 are prevented from disengaging from the supporting base 104. It should be noted that the term "disengaging" here means that the connection position of the first transition connecting member 114 and the first driven shaft 112 and/or the connection position of the second transition connecting member 120 and the second driven shaft 118 protrudes from the outer surface of the door body 100.

According to an embodiment of the present application, the cover plate assembly includes a cover plate base 140 and a cover plate body 142. Two ends of the first driven shaft 112 and two ends of the second driven shaft 118 are hinged to the cover plate base 140 respectively. The cover plate body 142 is mounted on the cover plate base 140.

Referring to FIG. 9 to FIG. 12, two ends of the first driven shaft 112 and two ends of the second driven shaft 118 are hinged to the cover plate base 140 respectively, and a cover plate body 142 is mounted on the cover plate base 140. The cover plate body 142 can be fixed with the cover plate base 140 by means of bonding, clamping, or the like. In other words, when the driving assembly drives the first swiveling rack 106 and/or the second swiveling rack 108 to operate, the first swiveling rack 106 and/or the second swiveling rack 108 can be driven to switch the cover plate base 140 and the cover plate body 142 between the position of avoiding the handle groove 102 and the position of shielding the handle groove 102. In an embodiment, the cover plate body 142 can be made of the same material as the outer surface of the door body 100, which can further improve the appearance consistency of the outer surface of the door body 100.

In an embodiment of the present application, as shown in FIG. 10, the door assembly further includes a light bar 144. In an embodiment, the cover plate base 140 is provided with a mounting space for mounting the light bar 144, and the cover plate body 142 is provided with a light transmission area at a position corresponding to the light bar 144. In other embodiments, the light bar 144 can be directly mounted under the cover plate body 142 and can act synchronously with the cover plate body 142.

By providing the mounting space for mounting the light bar 144 on the cover plate base 140 and providing a corresponding light transmission area on the cover plate body 142, when a human body approaches the door body 100, the first detecting member can detect the human body and generate a corresponding control signal. The light bar 144 can be automatically lit up after receiving the control signal, so that the user can recognize the position of the cover plate body 142. When the door body 100 is closed, the light bar 144 can be automatically turned off.

In an embodiment of the present application, the first detecting member is configured to detect the opening and closing states of the door body 100 or whether the user has leaved in addition to detect whether the human body is approaching. When the above situation is detected by the first detecting member, the first detecting member can generate a first detecting signal for controlling the driving assembly.

In an embodiment, when the first detecting member detects that a human body is approaching, which generally means that the user has a need to open the door, and the first detecting member is configured to generate the first detecting signal indicating that the door will be opened. After receiving the first detecting signal, the driving assembly can drive the first swiveling rack 106 and/or the second swiveling rack 108 to switch from the resetting state to the pressing state.

When the door body 100 is switched from the opening state to the closing state, the first detecting member can detect the action of the door body 100 to generate a first detecting signal indicating that the door body 100 is closed; or, when the user has left, the first detecting member can detect that the human body has left a nearby area of the door body 100 and generate a first detecting signal indicating that the door body 100 can be closed. After receiving the first detecting signal, the driving assembly can drive the first swiveling rack 106 and/or the second swiveling rack 108 to switch from the pressing state to the resetting state.

It should be noted that, in addition to sensors (such as infrared sensors and laser sensors) for detecting the distance of the human body, a sensor for detecting human biometric features (such as face recognition devices, voice recognition devices, etc.) can be selected as the first detecting member, and a pressure sensor and other sensors can also be selected as the first detecting member. For example, when the user touches a certain area of the door body, the first detecting signal is generated. That is, the present application does not have specific limitation on types and excitation methods of the first detecting member, as long as the opening and closing needs of the user can be determined.

Several ways of providing the driving assembly according to the embodiments of the present application will be described in the following.

Way I

The driving assembly includes a motor 126 mounted on the supporting base 104, and the motor 126 is connected to the first driving shaft 110 and/or the second driving shaft 116.

For example, in the way I, the motor 126 can be connected to the first driving shaft 110, so that when the door body 100 is in a closed state, if the first detecting member detects that a human body is approaching, which generally means that the user has a need to open the door, the first detecting member is configured to generate the first detecting signal indicating that the door will be opened. The motor 126 drives the first driving shaft 110 to move, so that the first swiveling rack 106 is switched from the resetting state to the pressing state, then the user can hold the handle groove 102 to open the door body 100. After the user leaves or the user closes the door body 100, the first detecting member can generate the first detecting signal indicating that the door body 100 is closed, and the motor 126 drives the first driving shaft 110 to swivel based on the first detecting signal, thereby switching the first swiveling rack 106 from the pressing state to the resetting state. Meanwhile, the second swiveling rack 108 is simultaneously switched from the pressing state to the resetting state under the leading of the first swiveling rack 106.

In an embodiment, the motor 126 can be connected to the second driving shaft 116, so that the second driving shaft 116 can be driven by the motor 126, so that the second swiveling rack 108 can be switched from the pressing state to the resetting state.

In an embodiment, the number of the motors 126 can be two. For example, the two motors 126 are connected to the first driving shaft 110 and the second driving shaft 116 respectively. One of the two motors 126 is configured to drive the first driving shaft 110, so that the first swiveling rack 106 can be switched from the pressing state to the resetting state; and another motor 126 is configured to drive the second driving shaft 116, so that the second swiveling rack 108 can be switched from the resetting state to the pressing state.

Way II

The driving assembly includes a motor 126 and an elastic member 128; the motor 126 is connected to the first driving shaft 110 and/or the second driving shaft 116; and the elastic member 128 is sleeved on the first driving shaft 110 and two ends of the elastic member 128 abut against the supporting base 104 and the first transition connecting member 114 respectively, and/or the elastic member 128 is sleeved on the second driving shaft 116 and two ends of the elastic member 128 abut against the supporting base 104 and the second transition connecting member 120 respectively.

In way II, referring to FIG. 19 to FIG. 24, the motor 126 being connected to the first driving shaft 110 and the elastic member 128 being sleeved on the first driving shaft 110 are taken as an example.

The motor 126 is connected to the first driving shaft 110 in a transmission manner and the elastic member 128 can be a torsion spring. The torsion spring is sleeved on the first driving shaft 110, and two ends of the torsion spring abut against the supporting base 104 and a side of the first transition connecting member 114 facing the inner surface of the door body 100 respectively.

In this way, when the door body 100 is in a closed state and the user approaches the door body 100, the first detecting member can control the motor 126 to operate, and then the motor 126 can be driven to swivel the first driving shaft 110, so that the rack is switched from the resetting state to the pressing state, and then the user can hold the handle groove 102 to open the door body 100, and at this time the torsion spring is tightened. After the user leaves or the user closes the door body 100, the torsion spring drives the first driving shaft 110 to swivel reversely under the action of torsional restoring force of the torsion spring, thereby switching the first swiveling rack 106 from the pressing state to the resetting state, and then the second swiveling rack 108 is synchronously switched from the pressing state to the resetting state under the leading of the first swiveling rack 106.

Alternatively, the motor 126 is connected to the first driving shaft 110, the torsion spring is sleeved on the first driving shaft 110, and two ends of the torsion spring abut against the supporting base 104 and a side of the first transition connecting member 114 facing the outer surface of the door body 100 respectively.

In this way, when the door body 100 is in the closed state, the torsion spring is in a tightened state, the motor 126 stops operating and is balanced with the torsional restoring force of the torsion spring. When the user approaches the door body 100, the first detecting member can control the motor 126 to operate to loosen the torsion spring, and then the torsion spring swivels the first driving shaft 110 under the action of its own torsional restoring force, so that the first swiveling rack 106 can be switched from the resetting state to the pressing state, and then the user can hold the handle groove 102 to open the door body 100. After the user leaves or the user closes the door body 100, the motor 126 operates reversely and swivels the first driving shaft 110 to overcome the torsional restoring force exerted by the torsion spring on the first transition connecting member 114, thereby switching the first swiveling rack 106 from the pressing state to the resetting state, and then the second swiveling rack 108 is simultaneously switched from the pressing state to the resetting state under the leading of the first swiveling rack 106. It should be noted that, during the rack switches from the resetting state to the pressing state, a smooth movement of the cover plate body 142 can be achieved by controlling a operation speed of the first swiveling rack 106 by controlling a rotational speed of the motor 126. Similarly, during the rack switches from the pressing state to the resetting state, the smooth movement of the cover plate body 142 can also be achieved by controlling the rotational speed of the motor 126.

In other words, in way II, the motor 126 can drive the rack to switch from the resetting state to the pressing state, and the torsion spring can drive the rack to switch from the pressing state to the resetting state; or the motor 126 drives the rack to switch from the pressing state to the resetting state, and the torsion spring drives the rack to switch from the resetting state to the pressing state.

In an embodiment, in way II, the motor 126 can be connected to the first driving shaft 110, the torsion spring is sleeved on the second driving shaft 116, and two ends of the torsion spring abut against the supporting base 104 and a side of the second transition connecting member 120 facing the inner surface of the door body 100 respectively. In this way, the first swiveling rack 106 can be driven by the motor 126 to switch from the resetting state to the pressing state, and the second swiveling rack 108 can be driven by the torsion spring to switch from the pressing state to the resetting state.

Alternatively, the motor 126 is connected to the first driving shaft 110, the torsion spring is sleeved on the second driving shaft 116, and two ends of the torsion spring abut against the supporting base 104 and a side of the second transition connecting member 120 facing the outer surface of the door body 100 respectively. In this way, the first swiveling rack 106 can be driven by the motor 126 to switch from the pressing state to the resetting state, and the second swiveling rack 108 can be driven by the torsion spring to switch from the resetting state to the pressing state.

Alternatively, the motor 126 is connected to the second driving shaft 116, the torsion spring is sleeved on the first driving shaft 110, and two ends of the torsion spring abut against the supporting base 104 and a side of the first transition connecting member 114 facing the inner surface of the door body 100 respectively. In this way, the second swiveling rack 108 can be driven by the motor 126 to switch from the resetting state to the pressing state, and the first swiveling rack 106 can be driven by the torsion spring to switch from the pressing state to the resetting state.

Alternatively, the motor 126 is connected to the second driving shaft 116, the torsion spring is sleeved on the first driving shaft 110, and two ends of the torsion spring abut against the supporting base 104 and a side of the first transition connecting member 114 facing the outer surface of the door body 100 respectively. In this way, the first swiveling rack 106 can be driven by the motor 126 to switch from the resetting state to the pressing state, and the second swiveling rack 108 can be driven by the torsion spring to switch from the resetting state to the pressing state.

Alternatively, the motor 126 is connected to the second driving shaft 116, the torsion spring is sleeved on the second driving shaft 116, and two ends of the torsion spring abut against the supporting base 104 and a side of the second transition connecting member 120 facing the inner surface of the door body 100 respectively. In this way, the second swiveling rack 108 can be driven by the motor 126 to switch from the resetting state to the pressing state, and the second swiveling rack 108 can be driven by the torsion spring to switch from the pressing state to the resetting state.

Alternatively, the motor 126 is connected to the second driving shaft 116, the torsion spring is sleeved on the second driving shaft 116, and two ends of the torsion spring abut against the supporting base 104 and a side of the second transition connecting member 120 facing the outer surface of the door body 100 respectively. In this way, the second swiveling rack 108 can be driven by the motor 126 to switch from the pressing state to the resetting state, and the second swiveling rack 108 can be driven by the torsion spring to switch from the resetting state to the pressing state.

Alternatively, the motor 126 is connected to the first driving shaft 110 and the second driving shaft 116, and both the first driving shaft 110 and the second driving shaft 116 are provided with a torsion spring. The motor 126 is configured to simultaneously drive the first driving shaft 110 and the second driving shaft 116 to switch from the resetting state to the pressing state. Correspondingly, the torsion springs simultaneously drive the first driving shaft 110 and the second driving shaft 116 to switch from the pressing state to the resetting state. Alternatively, the motor 126 is configured to simultaneously drive the first driving shaft 110 and the second driving shaft 116 to switch from the pressing state to the resetting state, and correspondingly, the torsion springs simultaneously drive the first driving shaft 110 and the second driving shaft 116 to switch from the resetting state to the pressing state.

It should be noted that, when the power is off, if the rack is in the resetting state, the user can manually press the cover plate assembly to switch the cover plate assembly from the resetting state to the pressing state, thereby the use can hold the handle groove 102 to open the door.

Way III

The driving assembly includes a magnetic member, where the magnetic member is mounted on the supporting base 104, and the magnetic member is adapted to drive the rack to switch between the pressing state and the resetting state based on the first detecting signal.

In way III, the magnetic member can be an electromagnet, and the number of the electromagnets can be two, where one of the two electromagnets is configured to drive the rack to switch from the resetting state to the pressing state, and another electromagnet is configured to drive the rack to switch from the pressing state to the resetting state.

In this way, when the door body 100 is in the closed state, after one of the two electromagnets receives the first detecting signal indicating that the door will be opened, the electromagnet is powered up and generates a magnetic force on the first swiveling rack 106 and/or the second swiveling rack 108, thereby driving the rack to switch from the resetting state to the pressing state, and then the user can hold the handle groove 102 to open the door body 100. After the user leaves or the user closes the door 100, this electromagnet is powered off, and another electromagnet is powered up and generates a magnetic force on the first swiveling rack 106 and/or the second swiveling rack 108, to switch the first swiveling rack 106 and/or the second swiveling rack 108 from the pressing state to the resetting state.

Way IV

The driving assembly includes a magnetic member and an elastic member 128, where the magnetic member is mounted on the supporting base 104, the elastic member is adapted to drive the rack to switch from the resetting state to the pressing state, and the magnetic member is adapted to drive the rack to switch from the pressing state to the resetting state.

Alternatively, the magnetic member is adapted to drive the rack to switch from the resetting state to the pressing state, and the elastic member is adapted to drive the rack to switch from the pressing state to the resetting state.

For the above-mentioned way I and way II, the supporting base 104 is further provided with a mounting plate 134 for mounting the motor 126, where the mounting plate 134 is provided with a shock pad 136, the motor 126 is mounted on the mounting plate 134 and an output shaft of the motor 126 is adapted to be connected to an end of the first driving shaft 110 and/or an end of the second driving shaft 116 through a shaft coupling 138.

Figure 25:
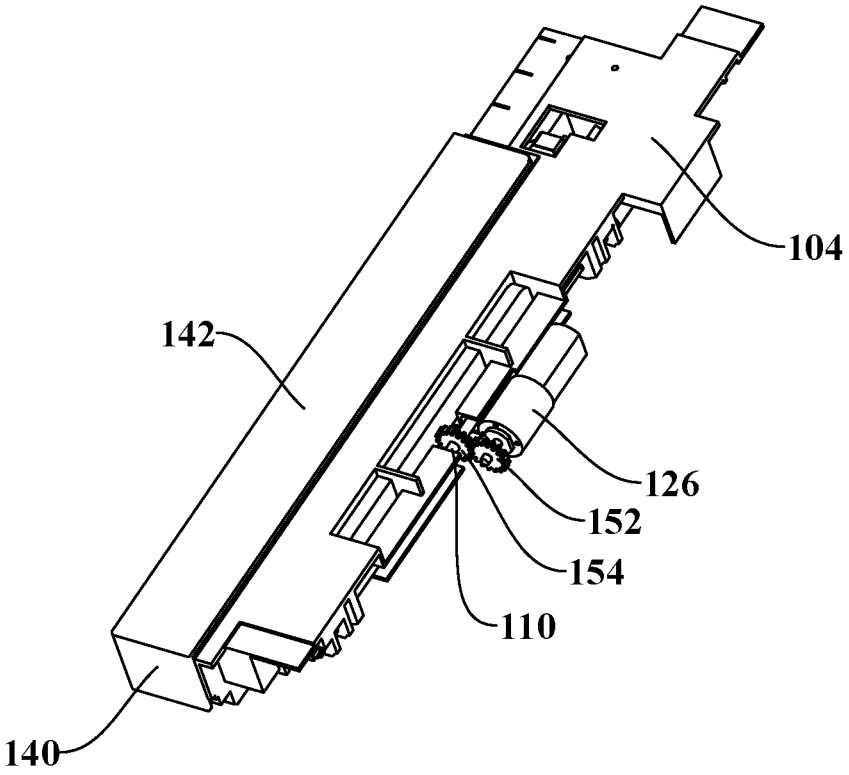
FIG. 25 is a schematic structural diagram of yet another driving assembly connecting to a rack according to an embodiment of the present application.

Alternatively, as shown in FIG. 25, the motor 126 can drive the first driving shaft 110 through the meshing transmission of a driving gear 152 and a driven gear 154. In other words, in this way, the motor 126 can be mounted at a middle position of the first driving shaft 110, which can save the mounting space of the motor 126 and reduce the space occupation of the driving assembly.

Referring to FIG. 10, by providing the shock pad 136, the vibration of the motor 126 during operation can be reduced, and the movement stability of the first swiveling rack 106 and/or the second swiveling rack 108 during swiveling can be improved. A shaft coupling 138 is provided between the output shaft of the motor 126 and the first driving shaft 110 and/or the second driving shaft 116. For example, the output shaft of the motor 126, the first driving shaft 110 and the second driving shaft 116 can be flat shafts, and correspondingly, a shaft hole on the shaft coupling 138 can be flat hole. In this way, the objective of swiveling the first driving shaft 110 and/or the second driving shaft 116 by the motor 126 can be achieved.

According to an embodiment of the present application, the door assembly further includes a second detecting member 130, where the second detecting member 130 is mounted on the supporting base 104, and the second detecting member 130 is adapted to generate a second detecting signal for controlling the motor 126 to stop after detecting that the rack switches to the resetting state.

For the above-mentioned way I and way II, the supporting base 104 is further provided with a second detecting member 130. The second detecting member 130 can be a micro switch or a proximity switch, etc. By providing the second detecting member 130, after the rack switches from the pressing state to the resetting state, the second detecting member 130 can detect the position of the rack and generate a second detecting signal. In the above-mentioned way I and way III, when the motor 126 is configured to drive the rack to switch from the pressing state to the resetting state, the motor 126 can be stopped based on the second detecting signal.

In other words, after the motor 126 drives the rack to switch from the pressing state to the resetting state, the second detecting member 130 is triggered and generates a second detecting signal, and then the motor 126 can be stopped after receiving the second detecting signal, so that the rack can stay in the resetting state.

Figure 7:
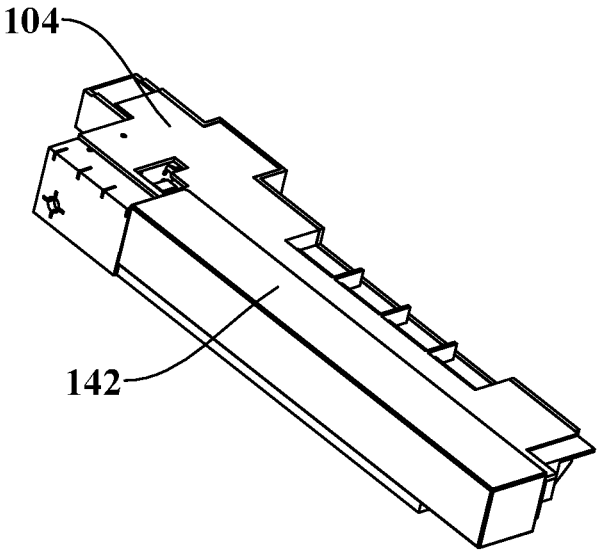
FIG. 7 is a schematic structural diagram of a cover plate assembly shielding a handle groove according to an embodiment of the present application.
Figure 8:
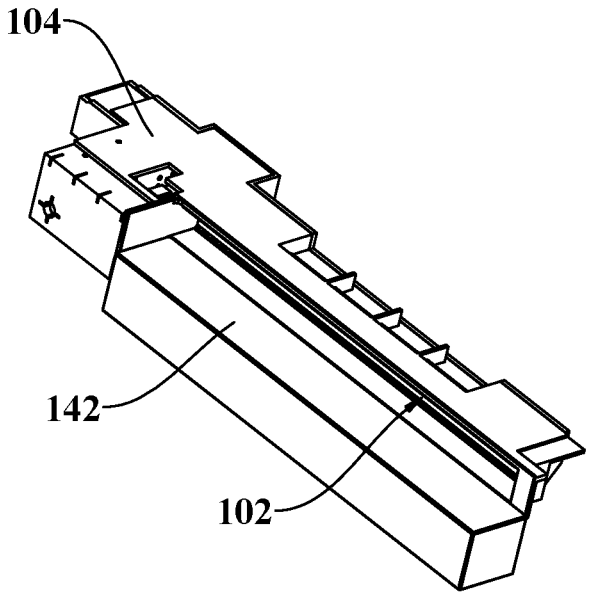
FIG. 8 is a schematic structural diagram of a cover plate assembly avoiding a handle groove according to an embodiment of the present application.
Figure 9:
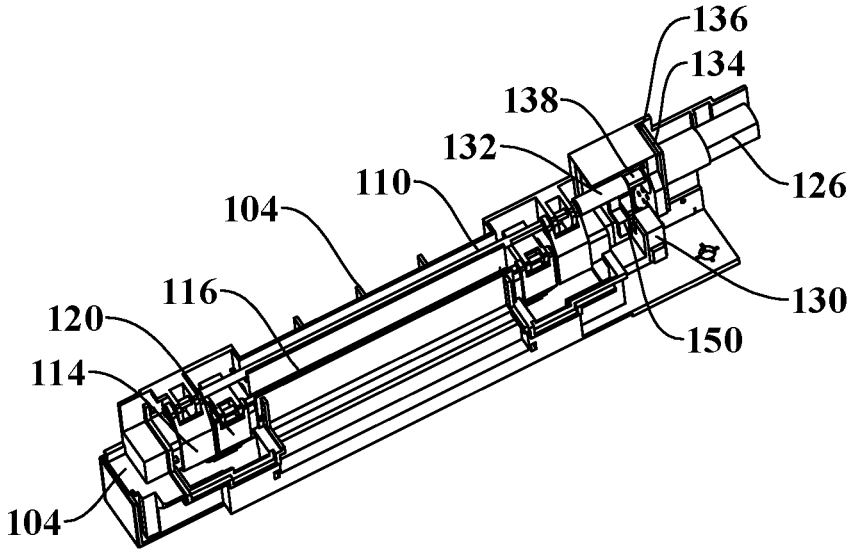
FIG. 9 is a schematic structural diagram of a supporting base, a first swiveling rack, and a second swiveling rack according to an embodiment of the present application.

Referring to FIG. 6 and FIG. 7, the first driving shaft 110 and/or the second driving shaft 116 is sleeved with a swing rod 132. In the resetting state, the swing rod 132 is adapted to trigger the second detecting member 130 to generate the second detecting signal.

In an embodiment, the swing rod 132 is connected to the first driving shaft 110, and the swing rod 132 is provided with a swing arm 150. For example, the swing rod 132 is provided with a flat hole, and the swing rod 132 is sleeved on the first driving shaft 110 through the flat hole. The swing arm 150 includes a first swing arm and a second swing arm. After the motor 126 drives the first driving shaft 110 to swivel and switches the first swiveling rack 106 from the pressing state to the resetting state, the first swing arm on the swing rod 132 can trigger the second detecting member 130 to generate the second detecting signal, then the motor 126 stops after receiving the second detecting signal, and then the rack can be kept in the resetting state.

Figure 11:
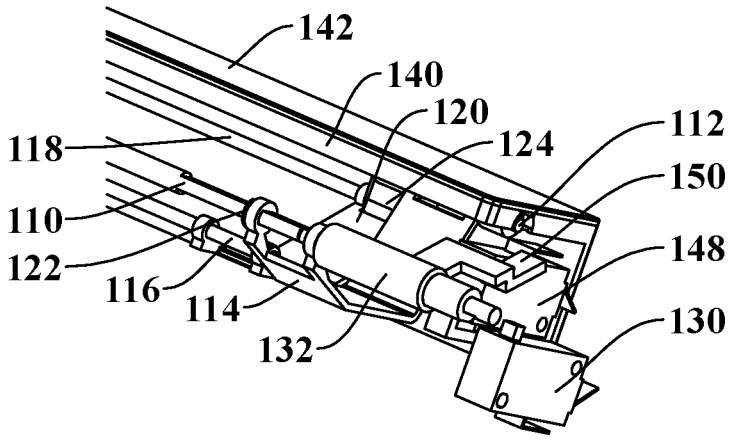
FIG. 11 is a schematic structural diagram of a first swiveling rack, a second swiveling rack and a cover plate assembly at an angle according to an embodiment of the present application.
Figure 12:
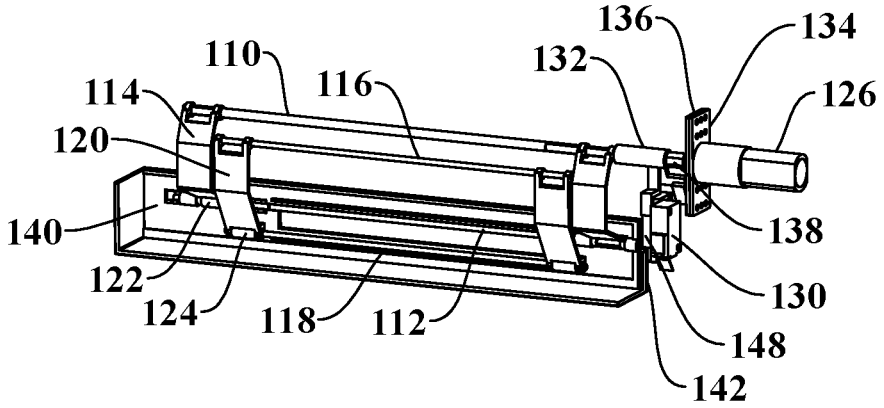
FIG. 12 is a schematic structural diagram of a first swiveling rack, a second swiveling rack and a cover plate assembly at another angle according to an embodiment of the present application.
Figure 13:
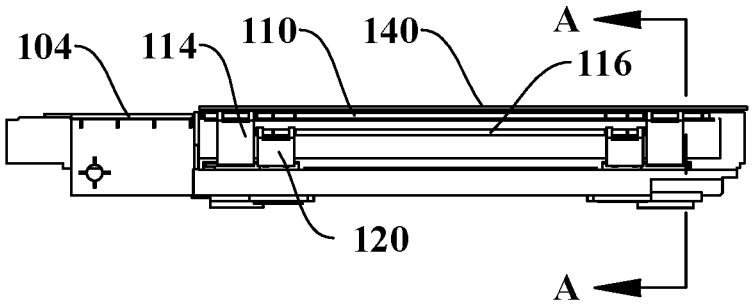
FIG. 13 is a schematic front view of a cover plate assembly shielding a handle groove according to an embodiment of the present application.

As shown in FIG. 10 to FIG. 12, in an embodiment of the present application, the door assembly is further provided with a third detecting member 148. The third detecting member 148 can be mounted on the supporting base 104, and the third detecting member 148 can be a micro switch or a proximity switch, etc. By providing the third detecting member 148, after the rack switches from the resetting state to the pressing state, the third detecting member 148 can detect the position of the rack and generate a third detecting signal. In the above-mentioned way I and way III, when the motor 126 is configured to drive the rack to switch from the resetting state to the pressing state, the motor 126 can be stopped based on the third detecting signal.

Similarly, in the pressing state, the swing rod 132 is adapted to trigger the third detecting member 148 to generate a third detecting signal. In an embodiment, the swing rod 132 is connected to the first driving shaft 110. For example, the swing rod 132 is provided with a flat hole, and the swing rod 132 is sleeved on the first driving shaft 110 through the flat hole. After the motor 126 swivels the first driving shaft 110 and drives the first swiveling rack 106 to switch from the resetting state to the pressing state, the second swing arm on the swing rod 132 can trigger the third detecting member 148 to generate a third detecting signal, then the motor 126 stops after receiving the third detecting signal, and then the rack can be kept in the pressing state.

It should be noted that, in the case where the third detecting member 148 is provided, the first swing arm and the second swing arm on the swing rod 132 are provided at a certain angle. That is, with the swivel of the first driving shaft 110, the first swing arm and the second swing arm on the swing rod 132 can trigger the second detecting member 130 and the third detecting member 148 respectively to control the motor 126 to stop.

In an embodiment of the present application, the second detecting member 130 and the third detecting member 148 may not be provided, and the controlling mode of the motor 126 for the first swiveling rack 106 and/or the second swiveling rack 108 can be adjusted only by setting the running duration of the motor 126.

For example, the motor 126 can be set to automatically stop after a running duration of 2 seconds. For example, when the motor 126 is stuck by foreign object when the motor 126 drives the first swiveling rack 106 to switch from the resetting state to the pressing state, the motor 126 stops after running 2 seconds. After the foreign object is taken out, the cover plate body 142 can be manually pressed to switch the rack to the pressing state, which can effectively prevent the motor 126 from being damaged due to a larger torque on the motor 126. The above-mentioned 2 seconds is only an illustrative example, and the running duration of the motor 126 can be selected within the range of 1 to 5 seconds.

By setting the running duration of the motor 126 as a preset duration, the motor 126 can automatically stop after the running duration reaches the preset duration, so that the second detecting member 130 and the third detecting member 148 are not needed to be provided, which will further reduce the costs of design and manufacturing. In addition, the rack can be kept in the pressing state according to user's actual usage needs, so as to facilitate the user to open the door body 100 at any time. Correspondingly, the objective of keeping the rack in the pressing state can be achieved by controlling the motor 126.

A storage cabinet according to an embodiment of the present application includes the above-mentioned door assembly.

According to the storage cabinet of the embodiment of the present application, by providing the above-mentioned door assembly, on the premise of ensuring the convenience of opening and closing the door body 100, the surface of the door body 100 can be kept flat and concise when the door body 100 is in the closed state.

In an embodiment of the present application, the storage cabinet can be a refrigerator, a freezer, a wine cabinet, or the like.

Finally, it should be noted that the above embodiments are only used to illustrate the solutions of the present application, but not to limit them; although the present application has been described in detail with reference to the foregoing embodiments, those of ordinary skill in the art should understand that they can still modify the solutions recorded in the aforementioned embodiments, or equivalent replace some of the features; however, these modifications or substitutions do not make the essence of the corresponding solutions separate from the scope of the solutions of the embodiments of the present application.

The above embodiments are only used to illustrate the present application, but not to limit the present application. Although the present application has been described in detail with reference to the embodiments, those of ordinary skill in the art should understand that various combinations, modifications or equivalent replacements to the solutions of the present application will not depart from the scope of the solutions of the present application, and should cover within the scope of the claims of this application.

What is claimed is:

1. A door assembly, comprising:

a door body, provided with a handle groove;

a driving assembly;

a rack, hinged to the door body and provided with a cover plate assembly; and a first detecting member, configured to generate a first detecting signal, wherein the driving assembly is configured to drive the rack to switch between a pressing state and a resetting state based on the first detecting signal, in the pressing state, the cover plate assembly offset from the handle groove, and in the resetting state, the cover plate assembly shielding the handle groove; and wherein the rack includes a swiveling rack, the swiveling rack including:

a driving shaft hinged to the door body;

a first driven shaft hinged to the cover plate assembly; and a first transition connecting member, connected between the driving shaft and the driven shaft; and wherein the driving assembly includes a motor mounted on the door body and connected to the driving shaft.

2. The door assembly of claim 1, wherein the swiveling rack comprises:

a first swiveling rack, wherein a first end of the first swiveling rack is hinged to the door body, and a second end of the first swiveling rack is hinged to the cover plate assembly; and a second swiveling rack, wherein a first end of the second swiveling rack is hinged to the door body, and a second end of the second swiveling rack is hinged to the cover plate assembly, wherein the driving assembly is configured to drive one or more of the first swiveling rack or the second swiveling rack, to move the cover plate assembly in a direction perpendicular to the door body.

3. The door assembly of claim 2, wherein the first swiveling rack comprises:

a first driving shaft, wherein two ends of the first driving shaft are hinged to the door body;

a first driven shaft, wherein two ends of the first driven shaft are hinged to the cover plate assembly; and a first transition connecting member, connected between the first driving shaft and the first driven shaft; and the second swiveling rack comprises:

a second driving shaft, wherein two ends of the second driving shaft are hinged to the door body;

a second driven shaft, wherein two ends of the second driven shaft are hinged to the cover plate assembly; and a second transition connecting member, connected between the second driving shaft and the second driven shaft.

4. The door assembly of claim 3, wherein the first transition connecting member is positioned at one or more of the first driving shaft or the first driven shaft through a first limiting structure; and the second transition connecting member is positioned at one or more of the second driving shaft or the second driven shaft through a second limiting structure.

5. The door assembly of claim 3, wherein the motor of the driving assembly is connected to one or more of the first driving shaft or the second driving shaft.

6. The door assembly of claim 5, wherein the motor is connected to one or more of an end of the first driving shaft or an end of the second driving shaft through a shaft coupling; or the motor is connected to one or more of the first driving shaft or the second driving shaft in a transmission manner through a transmission assembly.

7. The door assembly of claim 3, wherein the driving assembly comprises the motor and an elastic member;

wherein the motor is connected to one or more of the first driving shaft or the second driving shaft; and the elastic member is sleeved on the first driving shaft, and two ends of the elastic member abut against the door body and the first transition connecting member respectively; or the elastic member is sleeved on the second driving shaft, and two ends of the elastic member abut against the door body and the second transition connecting member respectively.

8. The door assembly of claim 3, wherein the driving assembly comprises a magnetic member, wherein the magnetic member is mounted on the door body, and the magnetic member is configured to drive the rack to switch between the pressing state and the resetting state based on the first detecting signal.

9. The door assembly of claim 1, further comprising a second detecting member, wherein the second detecting member is mounted on the door body, and the second detecting member is configured to generate a second detecting signal for controlling the motor to stop after detecting that the rack switches to the resetting state.

10. The door assembly of claim 9, wherein the driving shaft is sleeved with a swing rod, and in the resetting state, the swing rod is configured to trigger the second detecting member to generate the second detecting signal.

11. The door assembly of claim 9, wherein the door body is provided with a mounting plate, the motor is mounted on the mounting plate, and a shock pad is provided between the mounting plate and the motor;

wherein an output shaft of the motor is connected to an end of the driving shaft through a shaft coupling; or the output shaft of the motor is connected to the first driving shaft in a transmission manner through a transmission assembly.

12. The door assembly of claim 3, wherein one or more of the first transition connecting member or the second transition connecting member is limited at the door body through a groove side wall of the handle groove, to prevent the one or more of the first transition connecting member or the second transition connecting member from disengaging from the door body.

13. The door assembly of claim 3, wherein the cover plate assembly comprises:

a cover plate base, wherein two ends of the first driven shaft and two ends of the second driven shaft are hinged to the cover plate base respectively; and a cover plate body, mounted on the cover plate base.

14. The door assembly of claim 13, further comprising a light bar, wherein the cover plate base is provided with a mounting space for mounting the light bar, and the cover plate body is provided with a light transmission area at a position corresponding to the light bar.

15. The door assembly of claim 3, wherein the door body comprises a supporting base, and the handle groove is provided on the supporting base; and the first end of the first swiveling rack and the first end of the second swiveling rack are hinged to the supporting base, and the second end of the first swiveling rack and the second end of the second swiveling rack are hinged to the cover plate assembly.

16. The door assembly of claim 15, wherein the door body further comprises a mounting base, and the supporting base is mounted on the mounting base.

17. A storage cabinet, comprising a body and a door assembly coupled to the body, the door assembly including:

a door body, provided with a handle groove;

a driving assembly;

a rack, hinged to the door body and provided with a cover plate assembly; and a first detecting member, configured to generate a first detecting signal, wherein the driving assembly is configured to drive the rack to switch between a pressing state and a resetting state based on the first detecting signal, in the pressing state, the cover plate assembly offset from the handle groove, and in the resetting state, the cover plate assembly shielding the handle groove;

wherein the rack includes a swiveling rack, the swiveling rack including:

a driving shaft hinged to the door body:

a first driven shaft hinged to the cover plate assembly; and a first transition connecting member, connected between the driving shaft and the driven shaft; and wherein the driving assembly comprises a motor and an elastic member, the motor being connected to the driving shaft, the elastic member being sleeved on the driving shaft, and two ends of the elastic member abutting against the door body and the first transition connecting member respectively.

18. The storage cabinet of claim 17, wherein the swiveling rack comprises:

a first swiveling rack, wherein a first end of the first swiveling rack is hinged to the door body, and a second end of the first swiveling rack is hinged to the cover plate assembly; and a second swiveling rack, wherein a first end of the second swiveling rack is hinged to the door body, and a second end of the second swiveling rack is hinged to the cover plate assembly, wherein the driving assembly is configured to drive one or more of the first swiveling rack or the second swiveling rack, to move the cover plate assembly in a direction perpendicular to the door body.

19. The storage cabinet of claim 18, wherein the first swiveling rack comprises:

a first driving shaft, wherein two ends of the first driving shaft are hinged to the door body;

a first driven shaft, wherein two ends of the first driven shaft are hinged to the cover plate assembly; and a first transition connecting member, connected between the first driving shaft and the first driven shaft; and the second swiveling rack comprises:

a second driving shaft, wherein two ends of the second driving shaft are hinged to the door body;

a second driven shaft, wherein two ends of the second driven shaft are hinged to the cover plate assembly; and a second transition connecting member, connected between the second driving shaft and the second driven shaft.

20. The storage cabinet of claim 19, wherein the first transition connecting member is positioned at one or more of the first driving shaft or the first driven shaft through a first limiting structure; and the second transition connecting member is positioned at one or more of the second driving shaft or the second driven shaft through a second limiting structure.

* * * * *